United States Patent [19]

Chia

[11] Patent Number: 4,705,096

[45] Date of Patent: Nov. 10, 1987

[54] EXFOLIATION OF SURFACE OXIDE FROM CONTINUOUSLY CAST COPPER BAR IN CONJUNCTION WITH INLINE HOT ROLLING

[75] Inventor: E. Henry Chia, Carrollton, Ga.

[73] Assignee: Southwire Company, Carrollton, Ga.

[21] Appl. No.: 300,144

[22] Filed: Sep. 8, 1981

[51] Int. Cl.[4] ..... B22D 11/00

[52] U.S. Cl. ..... 164/476; 164/477; 164/486; 72/39

[58] Field of Search ..... 164/76.1, 476, 477, 164/270.1, 417, 486; 72/39, 40, 201; 29/81 B, 81 F, 81 K; 148/12.4, 156

[56] References Cited

U.S. PATENT DOCUMENTS 3,331,123 7/1967 Cofer ..... 164/476 X

FOREIGN PATENT DOCUMENTS 615261 6/1935 Fed. Rep. of Germany ..... 29/81 B
42-18235 9/1967 Japan ..... 72/39
51-5821 2/1976 Japan ..... 72/39

*Primary Examiner*—Kuang Y. Lin
*Attorney, Agent, or Firm*—Stanley Tate; Michael C. Smith; Frank A. Peacock

[57] ABSTRACT

A method is provided for removal of surface oxide from a continuously cast copper bar preparatory to inline hot rolling, wherein solidified bar continuously advancing from a continuous caster is directed to a continuous hot rolling mill, comprising: passing said advancing bar, being at hot rolling temperature, through a spray zone of selected quench capacity and impulse, such that for each segment of said bar passing through said spray zone, said oxide is quenched to a black heat but is not ablated and said underlying bar is subjected to a shallow quench; said spray zone being situated in close proximity to but selectively spaced upcourse from the first rolls of said hot rolling mill such that there is insufficient time for substantial reheating of said quenched oxide during the approach to said first rolls; whereupon as quenched segments of the advancing bar progressively approach said first rolls and said underlying bar begins to deform just prior to roll contact, said oxide spalls off the bar surfaces substantially. Thus, the protective copper oxide is not removed from the bar surface until immediately prior to roll contact thereby preventing reoxidation of the bar surface; and further, since the spray is necessarily nonablative in magnitude there is minimal effect on the temperature and hot forming characteristics of the underlying bar.

8 Claims, 3 Drawing Figures

EXFOLIATION OF SURFACE OXIDE FROM CONTINUOUSLY CAST COPPER BAR IN CONJUNCTION WITH INLINE HOT ROLLING

BACKGROUND OF THE INVENTION

This invention relates generally to removal of surface oxide from an elongate copper workpiece preparatory to hot rolling and relates specifically to spray descaling of continuously cast copper bar prior to inline hot rolling.

The manufacture of copper rod in a continuous casting system is an integrated process in which a continuous bar of indefinite length is continuously solidified in a continuous casting machine and directed from the exit point of the casting machine to an inline continuous rolling mill wherein the nascent bar is hot formed into rod while still in a plastic state. The surface of the nascent bar immediately oxidizes as soon as the hot bar surface is exposed to the atmosphere upon emerging from the casting channel. This surface oxidation preferably should be removed before the bar enters the rolling mill, otherwise particles of oxide from the surface will be rolled into the bar with the typical result that the strength, ductility, and conductivity of the resulting hot formed rod is reduced by the presence of imbedded oxide particles.

Various approaches have been taken for descaling hot bar prior to hot rolling. One approach involves spray descaling wherein a high pressure spray of quench fluid is directed against the hot oxide surface layer to effect removal by a combination of thermal shock and ablation. While descaling by spraying as the advantage of simplicity of associated apparatus, it has the disadvantage that the spray volume necessary for sufficient ablative force to knock the fractured oxide layer from the bar may cause excessive heat removal from the underlying bar relative to the required hot working temperature range. An example of improved spray descaling is shown in U.S. Pat. No. 4,070,884 issued Jan. 31, 1978.

Another descaling approach may be termed mechanical descaling wherein the bar surface is mechanically abraded, as by scrapers, wire brushes, and the like, just prior to the bar entering the hot rolling mill, as representatively shown in U.S. Pat. No. 3,331,123 issued July 18, 1967. However, the degree of mechanical abrasion necessary for complete removal of the surface oxide layer also wastefully removes a layer of the underlying unoxidized metal, which in extreme cases may introduce significant variation in cross-sectional area of the bar along its length so as to interfere with the rolling schedule.

Another descaling approach involves ambient atmosphere control. In one mode, oxide is prevented from forming by providing a nonoxidizing atmosphere, thereby eliminating the need to descale, as representatively shown in U.S. Pat. No. 3,257,835 issued June 28, 1966. however, it may be difficult to prevent exposure of the bar to oxidation at the point where the continuous bar emerges from the continuous caster. In another mode of descaling by atmosphere control, a reducing atmosphere is provided about the bar in advance of the rolling mill so that the surface oxide is dissipated by chemical reduction. However, the speed of this reaction is typically significantly less than that required to be commensurate with commercial continuous casting rates. In another mode, a nonoxidizing atmosphere is provided in combination with either spray or mechanical descaling devices to prevent reoxidation during transit from the descaling device to the rolling mill entrance, as representatively shown in U.S. Pat. No. 4,099,399 issued July 11, 1978.

The present invention is concerned with spray descaling. It may generally be seen from the foregoing that spray descaling has several advantages over the other approaches for descaling in that associated apparatus is relatively simple and easily controlled. While preserving these general advantages, the spray descaling approach of the present invention provides, in a continuous casting system, for effective descaling without adversely affecting surface quality or hot forming characteristics of the underlying bar and in a manner that substantially prevents reoxidation during transit from descaling to hot rolling.

SUMMARY OF THE INVENTION

The method of the invention provides for removal of surface oxide from a continuously cast copper bar preparatory to inline hot rolling, wherein solidified bar continuously advancing from a continuous caster is directed to a continuous hot rolling mill, comprising:

passing said advancing bar, being at hot rolling temperature, through a spray zone of selected quench capacity and impulse, such that for each segment of said bar passing through said spray zone, said oxide is quenched to a black heat but is not ablated and said underlying bar is subjected to a shallow quench;

said spray zone being situated in close proximity to be selectively spaced upcourse from the first rolls of said hot rolling mill such that there is insufficient time for substantial reheating of said quenched oxide during the approach to said first rolls;

whereupon as quenched segments of the advancing bar progressively approach said first rolls and said underlying bar begins to deform just prior to roll contact, said oxide spalls off the bar surfaces substantially.

Thus, the protective copper oxide is not removed from the bar surface until immediately prior to roll contact thereby preventing reoxidation of the bar surface; and further, since the spray is necessarily nonablative in magnitude there is minimal effect on the temperature and hot forming characteristics of the underlying bar.

Thus, the upcourse separation of said spray zone from said rolls is adjusted during process operation so as to cause and enhance said spalling. It is believed that by so doing, the upcourse separation of said spray zone from said rolls is selected such that transit time from said spray zone to said rolls is sufficient for substantial reheating of the shallow quench layer in the copper bar but not said surface oxide thereby setting up substantial interfacial thermal stress and placing the oxide in tension.

Advantageously, the surface oxide is quenched to a temperature moderately below about 300° C., further provided that reheating conditions are such that said oxide reheats to above about 300° C. during transit to roll contact. On cooling cupric oxide below 300° C., a phase transformation occurs forming cuprous oxide and is accompanied by a sudden volumetric contraction. On reheating above 300° C., the transformation reverses causing a sudden expansion. This sudden expansion in the oxide amplifies the tensile stress set up by the interfacial thermal stress during selective reheating of the underlying copper bar.

Advantageously, the extent of compressive reduction in said first rolls is at least sufficiently large so as to cause substantially complete recrystallization of the as cast grain structure of said bar, thereby tending to maximize deformation in advance of roll contact.

BRIEF DESCRIPTION OF THE DRAWINGS

Further details are given below with reference to the drawings wherein.

PREFERRED MODES OF THE INVENTION

Figure 1:
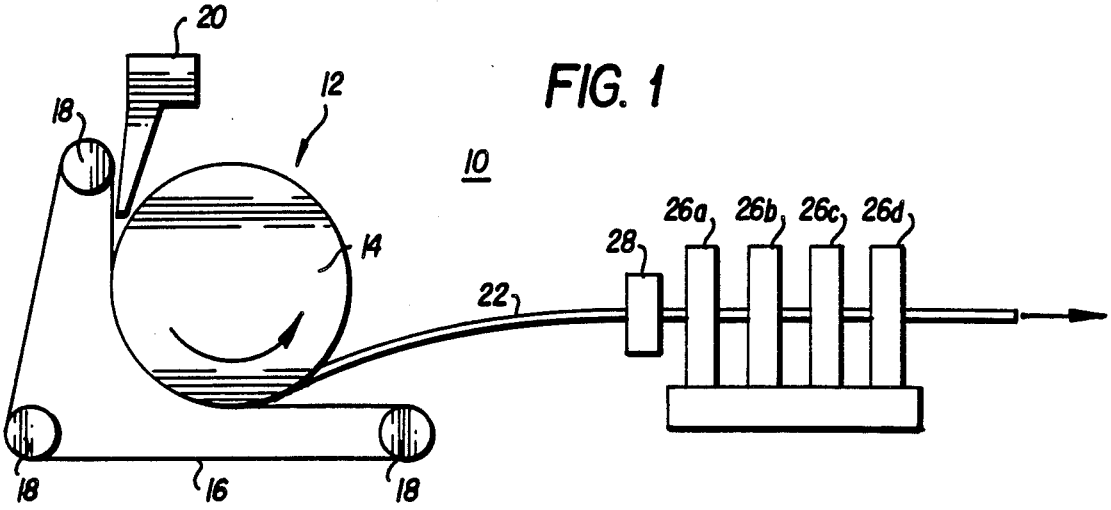
FIG. 1 schematically illustrates the general use of the spray descaler of the present invention in conjunction with typical prior art apparatus for the continuous casting and inline hot rolling of continuous copper bar.
Figure 2:
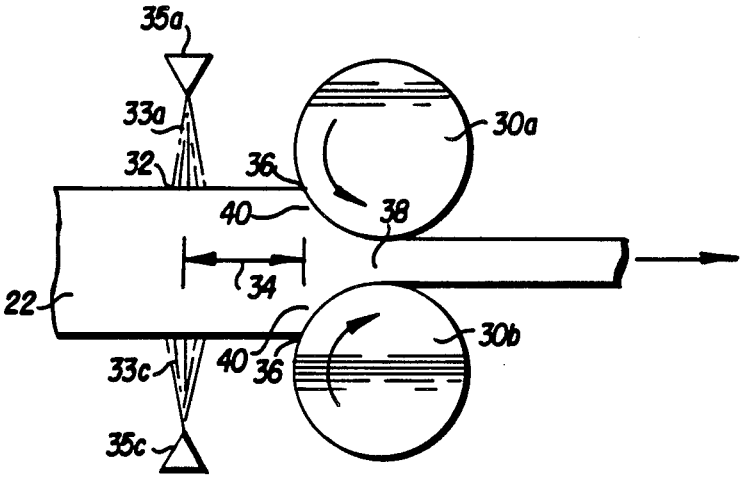
FIG. 2 schematically indicates spray zone configuration and selective upcourse placement relative to the first roll pair.
Figure 3:
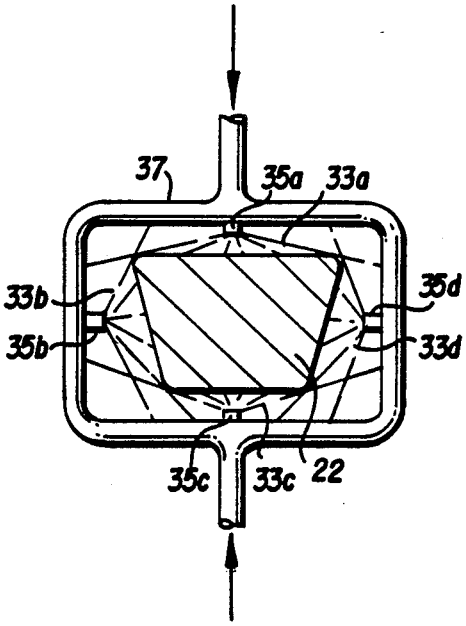
FIG. 3 shows a transverse section through the bar with fan sprays impinging on the bar surfaces, the fan sprays flowing from nozzles mounted in a conduit system about the bar periphery.

Referring now particularly to the drawings, in FIG. 1 typical prior art apparatus for the continuous casting and inline hot rolling of copper bar is schematically illustrated to indicate the general use of the present invention. The continuous casting and hot forming system 10 includes a casting machine 12 which includes a casting wheel 14 having a peripheral groove therein, a flexible band 16 carried by a plurality of guide wheels 18 which urge the flexible band 16 against the casting wheel 14 for a portion of the circumference of the casting wheel to cover the peripheral groove and form a mold or casting channel between the band 16 and the casting wheel 14. As molten metal is poured into the mold through pouring spout 20, the casting wheel 14 is rotated and the band 16 moves with the casting wheel to form a moving mold. A cooling system (not shown) within the casting machine 12 causes the molten metal to solidify in the mold and to exit the casting wheel 14 as a solid cast bar 22. From the casting machine 12, the cast bar 22 passes through a continuous hot rolling mill 24, which includes a plurality of roll stands 26. The roll stands of the rolling mill provide the primary hot forming of the cast bar by compressing the bar sequentially until the bar is reduced to a desired cross-sectional size and shape. Representative examples of continuous casters are shown in U.S. Pats. Nos. 3,766,967 (10/73) and 3,279,000 (10/66). Representative examples of continuous hot rolling are shown in U.S. Pats. Nos. 3,317,994 (5/67), 3,881,337 (5/75), and 3,315,349 (4/67).

In the present invention, the continuous caster and the inline continuous hot rolling mill for copper bar are combined with a spray descaling unit, indicated generally at 28, which is situated immediately prior to but spaced apart from the rolling mill entrance and having selected characteristics. It has been discovered that by spraying the surface of the advancing bar with a high pressure, low volume spray situated a relative small, but selected, distance upcourse from the rolling mill entrance that the oxide scale will shed from the bar just prior to the bar contacting the first roll pair, but that the low volume spray is not of sufficient quench capacity to substantially lower the bar temperature, being in the hot working range, further provided that the force or impulse of the spray is selected so as not to ablate the scale in the spray zone, with the result that the bar is not susceptible to reoxidation in the interval between the spray zone and the roll entrance.

For purposes herein, the term "copper" is used broadly to refer not only to high purity copper, but also to all the commercial grades of copper and copper alloys that are susceptible to scale formation at high temperature.

In FIG.'s 2 and 3, the spray zone configuration is shown schematically. The nascent bar 22 advances toward the first roll stand **26*a* having counterrotating compressive rolls 30*a,b*. The bar passes through the spray zone at 32 which is located a selected distance 34 upcourse of bar-roll contact at 36. The bar is subjected to compressive reduction and recrystallization in passing through the roll throat 38. The upcourse component of the compressive force exerted on the bar at bar-roll contact causes just in advance of contact some deformation in the surface layers of the bar indicated generally at 40. This is the area where energetic spalling of the scale takes place in accordance with the invention. In extreme cases, this predeformation may be manifested by surface cracking or even hot tearing in advance of roll contact. The spray zone is established by fan spray 33*a,b,c,d* that provide a narrow line spray distribution across the bar surfaces, respectively, to cause an impulse quench as a bar segment passes through the spray zone. Spray nozzles 35*a,b,c,d* are of the type generally characterized as high pressure, low volume nozzles. Quench fluid may be supplied to the nozzles through a rigid conduit arrangement 37** that generally encircles the bar periphery which also serves as a mounting platform for the spray nozzles.

Considering the sequence of operation, first, the advancing nascent bar emerges from the casting channel of the casting wheel with a surface temperature near the melting temperature of the copper alloy being cast, representatively about 1030° C. The high temperature bar surface oxidizes readily upon exposure to the atmosphere when departing the casting channel. Oxidation of the bar surface continues during transit to the spray descaler, with scale thickness developing to 50–100 microns typically. At the spray zone entrance, the bar surface temperature has cooled somewhat by natural convection, but transit time is relatively short so that the bar temperature remains well within the hot working range, typically about 850 to 1000° C. As the advancing bar passes through the spray zone of the descaler, the oxide layer is quenched to a "black heat", i.e. the scale on the bar surface is quenched from a red hot temperature to a temperature below about 500° C. such that the bar surface appears black in that thermal radiation emitted from the bar surface is below the visible spectrum. However, quench capacity of the spray is moderated such that the underlying bar is subjected only to a shallow quench, i.e. depth of quench into the underlying bar does not substantially effect the heat content of the overall bar as further discussed below.

The quench capacity of the spray is determined by several factors such as quench fluid medium and temperature, spray pressure, volumetric flow, and spray pattern. In general, the spray parameters are selected so as to tend to maximize impulse quenching in the oxide layer and into the bar to a shallow depth. Thus, the quench fluid and its temperature are selected to promote rapid heat transfer, representatively brine, water, or oil at room temperature. However, spray volumetric flow is minimally selected so that the mean temperature across the bar is not substantially lowered, otherwise hot rolling would be adversely effected. Conversely, spray pressure is maximized, consistent with this objective, so as to maximize the heat transfer at the bar surface, but is not so great however as to ablate the oxide layer, since the accumulated oxide layer serves as a protective covering on the bar against further oxidation until the quenched bar segment approaches the first roll pair. The spray pattern is selected to provide substantially a line distribution, e.g. a fan spray, to maximize the impulse quench effect.

The spray is situated so that the spray zone is spaced slightly upcourse from the first roll pair by a selected distance. This upcourse spacing is selected so that the transit time from the spray zone to the roll entrance is sufficient for substantial internal reheating of the shallow quench shell in the copper bar from the hot interior portion of the bar, but not sufficient for substantial reheating of the oxide layer. This differential reheating is possible since heat flow is from the high temperature interior of the bar and since the thermal conductivity of copper is much greater than that of copper oxide. By providing for this differential reheating, substantial interfacial thermal stress is established at the scale-copper interface, thereby placing the relatively fragile oxide layer in tension. As an operating rule-of-thumb, this upcourse separation will necessarily be less than that separation that just allows the scale to reheat to a glowing condition. For definitional purposes, the extent of reheating in the scale is taken relative to the extent of reheating in the shallow-quenched layer in the underlying copper bar.

Next, the quenched bar segment approaches the first roll pair. As the advancing bar contacts the rolls and passes through the roll throat, the bar undergoes substantial deformation. If the oxide scale is not removed prior to this point, then the oxide undesirably will be crushed into the bar. However, just in advance of bar-roll contact there is an anticipatory effect due to a backward or upcourse force component of the roll force on the engaged bar such that significant deformation occurs in the bar surface just prior to roll contact. The greater the deformation in the roll throat, the more extensive is this predeformation effect. As the advancing bar segments enter this predeformation zone just prior to roll contact, the oxide scale, being at this point under thermal tension, is seen to spall from the bar surface, so that substantially all of the scale energetically sheds from the bar just prior to the bar contacting the rolls.

Thus, by selectively adjusting the upcourse spacing of the spray zone from the predeformation zone for a given set of operating conditions, this energetic spalling condition may be established. Furthermore, since the scale is not ablated from the bar in the spray zone, the bar surface is not reoxidized in the interval between the spray zone and roll-contact.

The invention is especially suited for systems wherein the first roll stand compression is sufficiently large so as to cause substantially complete recrystallization of the as cast grain structure throughout the cross-section of the bar, as representatively shown in U.S. Pat. No. 3,317,994 cited above. This condition tends to maximize the extent of the predeformation zone.

As seen from the foregoing, interfacial thermal stress is believed to be important in the operation of the invention. Another effect believed to be operative under certain process conditions has to do with the chemical forms of copper oxide. In the range of about 300 to 1030° C., the stable form is cupric oxide (CuO) which has a monoclinic structure. Below 300° C., the stable form is cuprous oxide ($Cu_2O$) which has a cubic structure. Owing to the different densities of the two forms, when cupric oxide is cooled below 300° C. and consequently decomposes to cuprous oxide, volumetric expansion of about 7% accompanies the phase transition. Conversely, on heating cuprous oxide above 300° C. in the presence of oxygen, about 7% volumetric contraction will accompany the phase transition to cupric oxide. This reversible sudden expansion-contraction cycle may be advantageously applied in the present invention. The nascent bar emerging from the casting channel is then exposed to atmospheric oxidation. Since the bar surface temperature during oxidation is typically, slightly less than 1030° C., the surface oxide first forms as cupric oxide (CuO). The bar surface continues to oxidize as cupric oxide during transit toward the hot rolling mill. Upon a bar segment passing into the spray zone, the oxide layer is impulse quenched, and if quenched to a temperature less than 300° C., the cupric oxide decomposes to cuprous oxide. This decomposition or phase transition stresses the scale layer relative to the copper bar substrate since there is a sudden 7% volume expansion due to the differing densities of the two phases; and further, since the two phases are of different crystal structures, incoherency stresses are set up at the scale-bar interface. Next, and if the oxide was quenched to not to great an extent below 300° C., then the oxide will reheat to above 300° C. during transit from the spray zone to the roll entrance. This slight reheating in the oxide will reverse the reaction to again form cupric the oxide with an associated 7% volumetric contraction. This phase contraction will amplify the tensile stress in the oxide layer that is established by the interfacial thermal stress pattern as discussed above in connection with the selected upcourse separation of the spray zone from the rolls. Thus, by quenching the oxide scale slightly below 300° C. in the spray zone, scale spalling in the predeformation zone at the roll entrance is amplified.

Optionally, it may be preferred for certain operating configurations to provide a relatively weak secondary or sweeping spray (not shown) directed to the upper horizonal surface of the bar in the spalling zone just in advance of bar-roll contact. The purpose of this spray is to sweep away any residual spalled oxide fragments loosely resting on the upper surface of the bar. This feature becomes more desirable with increasing width of the upper bar surface. The magnitude of this sweeping spray is only minimal for the sweeping action, so as not to cause any significant quenching of the bar. The secondary spray fluid should be nonoxidizing, such as water or inert gas.

As an example of use of the invention, a continuously cast copper bar was descaled in a continuous copper rod system. The bar was composed of tough pitch, electrolytic copper and had a trapezoidal cross-section of about 3 $in^2$ area (19.4 $cm^2$) and a major width to side ratio of about 1.5. Casting speed was about 35 feet per minute (10.7 meters per minute) and transit time from the caster to the rolling mill was about 1.4 minutes. Entering the spray zone, the bar surface temperature was about 1650° F. (900° C.) and the bar centerline temperature was estimated to be about 1800° F. (980° C.). The spray zone was formed by four sprays, directed to each of the four sides respectively. The sprays were flat fan sprays and were oriented so that the spray distribution formed a line across the transverse dimension of the respective bar side. The spray nozzles were spaced from the respective bar surfaces by about 2 to 3 inches (5 to 8 cm), and were operated at a nozzle pressure of about 6000 psi (420 kg/cm$^2$), each having a volumetric flow of about 13.2 gallons per minute (50 liters/min.). The nozzles were manufactured by the Partek Corporation of Houston, Tex. The quench medium was water at about 20° C. The upcourse separation of the spray zone from the bar-roll contact point in the first roll stand was adjusted until energetic spalling of the oxide scale was observed just in advance of the bar-roll contact point. This operative separation was determined to be about 4 to 5 inches (10 to 13 cm) for substantial descaling of the bar just prior to contacting the rolls. For comparison, no descaling effect was produced at a separation, for example, of 12 to 15 inches (30 to 38 cm).

Although the present invention has been described in conjunction with preferred embodiments, it is to be understood that modifications and variations may be utilized without departing from the principles and scope of the invention as those skilled in the art will readily understand. Accordingly, such modifications and variations may be practiced within the scope of the following claims:

What is claimed is:

1. A method for removal of surface oxide from a continuously cast copper bar preparatory to inline hot rolling, wherein solidified bar continuously advancing from a continuous caster is directed to a continuous hot rolling mill, comprising:

passing said advancing bar, being at hot rolling temperature, through a spray zone of selected quench capacity and impulse, such that for each segment of said bar passing through said spray zone, said oxide is quenched to a black heat but is not ablated and said underlying bar is subjected to a shallow quench;

said spray zone being situated in close proximity to but selectively spaced upcourse from the first rolls of said hot rolling mill such that there is insufficient time for substantial reheating of said quenched oxide during the approach to said first rolls;

whereupon as quenched segments of the advancing bar progressively approach said first rolls and said underlying bar begins to deform just prior to roll contact, said oxide spalls off the bar surfaces substantially; thereby descaling said bar while minimally effecting its hot forming characteristics and preventing reoxidation prior to rolling.

2. The method of claim 1 wherein the upcourse separation of said spray zone from said rolls is selected during process operation so as to cause and enhance said spalling.

3. The method of claim 2 wherein the upcourse separation of said spray zone from said rolls is adjusted such that transit time from said spray zone to said rolls is sufficient for substantial reheating of the shallow quench layer in the copper bar but not said surface oxide thereby setting up substantial interfacial thermal stress and placing said oxide in tension.

4. The method of claims 1, 2, or 3 wherein said oxide is quenched to a temperature moderately below about 300° C., further provided that reheating conditions are such that said oxide reheats to above about 300° C. during transit to roll contact.

5. The method of claims 1, 2, or 3 wherein the extent of compressive reduction in said first rolls is sufficiently large so as to cause substantially complete recrystallization of the as cast grain structure of said bar.

6. The method of claim 3 wherein said oxide is quenched to a temperature moderately below about 300° C., further provided that reheating conditions are such that said oxide reheats to above about 300° C. during transit to roll contact; and wherein the extent of compressive reduction in said first rolls is sufficiently large so as to cause substantially complete recrystallization of the as cast grain structure of said bar.

7. The method of claims 1 or 6 further comprising, sweeping away any residual spalled oxide fragments resting on the upper surface of said bar just prior to roll contact with a second spray zone of nonoxidizing fluid and of low impulse.

8. A method for removal of surface oxide from a continuously cast copper bar preparatory to inline hot rolling, wherein nascent bar continuously advancing from a continuous casting machine is directed to a continuous rolling mill, comprising the steps of:

(a) passing said advancing bar in its as cast condition through a spray zone of selected quench capacity and impulse such that the surface oxide is quenched to a black heat but not ablated and said underlying bar is subjected to only a shallow quench and the temperature of said bar remains at a hot forming temperature for copper;

(b) preventing exposure of unoxidized bar to an oxidizing atmosphere before said bar enters the first rolls of said rolling mill;

(c) passing said bar to the first rolls of said rolling mill before substantial reheating of said quenched oxide can occur;

(d) spalling said quenched oxide from said bar substantially immediately before said surface oxide contacts the first rolls of said rolling mill; and (e) hot rolling said descaled bar before reoxidation of the bar surface can occur.

* * * * *